US006260505B1

(12) United States Patent
Polidan

(10) Patent No.: US 6,260,505 B1
(45) Date of Patent: Jul. 17, 2001

(54) PONTOON BOAT COVER SYSTEM

(75) Inventor: David G. Polidan, Fenton, MI (US)

(73) Assignee: Midwest Pontoon Covers, Inc., Grand Blanc, MI (US)

( * ) Notice: Subject to any disclaimer, the term of this patent is extended or adjusted under 35 U.S.C. 154(b) by 0 days.

(21) Appl. No.: 09/454,088

(22) Filed: Dec. 3, 1999

(51) Int. Cl.[7] ..... B63B 17/00
(52) U.S. Cl. ..... 114/361
(58) Field of Search ..... 114/343, 361, 114/364

(56) References Cited

U.S. PATENT DOCUMENTS

| | | | | |
|---|---|---|---|---|
| 2,493,833 | * | 1/1950 | Reynolds | 114/361 |
| 3,354,892 | | 11/1967 | Frieder | 135/6 |
| 3,399,687 | | 9/1968 | Frieder | 135/6 |
| 4,300,253 | | 11/1981 | Anderson | 9/1.5 |
| 4,671,203 | | 6/1987 | Sanburg | 114/361 |
| 4,979,456 | | 12/1990 | Steward | 114/351 |
| 5,070,807 | | 12/1991 | Lewis | 114/361 |
| 5,106,931 | | 4/1992 | Sagane et al. | 526/282 |
| 5,351,847 | * | 10/1994 | Greenbaum | 220/401 |
| 5,520,139 | * | 5/1996 | King et al. | 114/361 |
| 5,803,007 | * | 9/1998 | Stevens | 114/361 |

* cited by examiner

*Primary Examiner*—Stephen Avila
(74) *Attorney, Agent, or Firm*—Young & Basile, P.C.

(57) ABSTRACT

A cover system for a pontoon boat having a rail is disclosed. The cover system includes a framework for receiving a flexible material cover thereon. The framework has hollow end fittings engageable to brackets. Each bracket has a U-shaped configuration with inwardly projected protuberances along lateral ends to grasp the underside of the rail. The bracket has a center section between two lateral sections and the center section has a vertically extending portion thereon configured for being received into an end fitting.

5 Claims, 2 Drawing Sheets

PONTOON BOAT COVER SYSTEM

FIELD OF THE INVENTION

The invention relates to the framework for a cover system on a pontoon boat.

BACKGROUND OF THE INVENTION

It is known to provide canopy or cover systems to boats. Some of the cover systems for boats are used as a camouflage to provide a duck blind during hunting season. Other canopies or cover systems are used mainly to protect the interior of the boat from inclement weather. Most of the available cover systems are configured for installation on a typical boat. The cover and frame systems are not designed for use on a pontoon boat having a large flat surface area or on a pontoon boat having a railing system rather than sidewalls. Further, the cover systems of the prior art require extensive clamping mechanisms to secure the cover system to the boat. A clamping mechanism such as disclosed in U.S. Pat. No. 4,979,456 issued to Steward requires a U-shaped bracket and an associated screw for engaging the sidewall of the boat. One disadvantage found with this type of cover system is that screws and brackets can be misplaced. In addition, the installation time is lengthened by having to manually tighten each screw into the appropriate bracket. Further, the cover system as disclosed in the prior art is not suitable for a pontoon boat wherein a pontoon boat has a railing system along an entire or partial perimeter of the pontoon boat, instead of sidewalls. The pontoon boat may also have a low deck rail along another portion of the pontoon boat. The lightweight railing system of the pontoon boat may not support the bracket and screw clamping means of the prior art.

SUMMARY OF THE INVENTION

It is the intent of the present invention to address the aforementioned concerns. The present invention provides a cover system for a pontoon boat having a railing system extending above the floor of the pontoon boat and encompassing around at least most of the perimeter of the boat, wherein the railing system is defined by a pair of side rails and at least one end rail. The cover system comprises a frame system releasably attachable to the railing system at a plurality of locations. The frame system includes elongate members interconnected into a plurality of arched formations. The arch formations are connected by a traversely extending member. The elongate members have end portions that are permanently or releasably mountable into one end of individual hollow fittings. The cover system further provides attachment means grippingly securable to the railing system. The attachment means has a vertically extending portion slidably mountable into the other end of the individual hollow fittings. One feature of the attachment means includes a bracket that snap fits or clips onto the rail and remains secured on the rail until removal. The attachment means can slide along the rail for accurate positioning and then easily snaps off the rail for removal.

Another feature of the invention provides a means for extending the cover system over a decking area and including an elongate member angularly connected to one of the arched formations and extending to a deck rail having a lower height than the railing system. The elongate member extends to and is connected to a crossover bar which extends between two of the deck rails.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
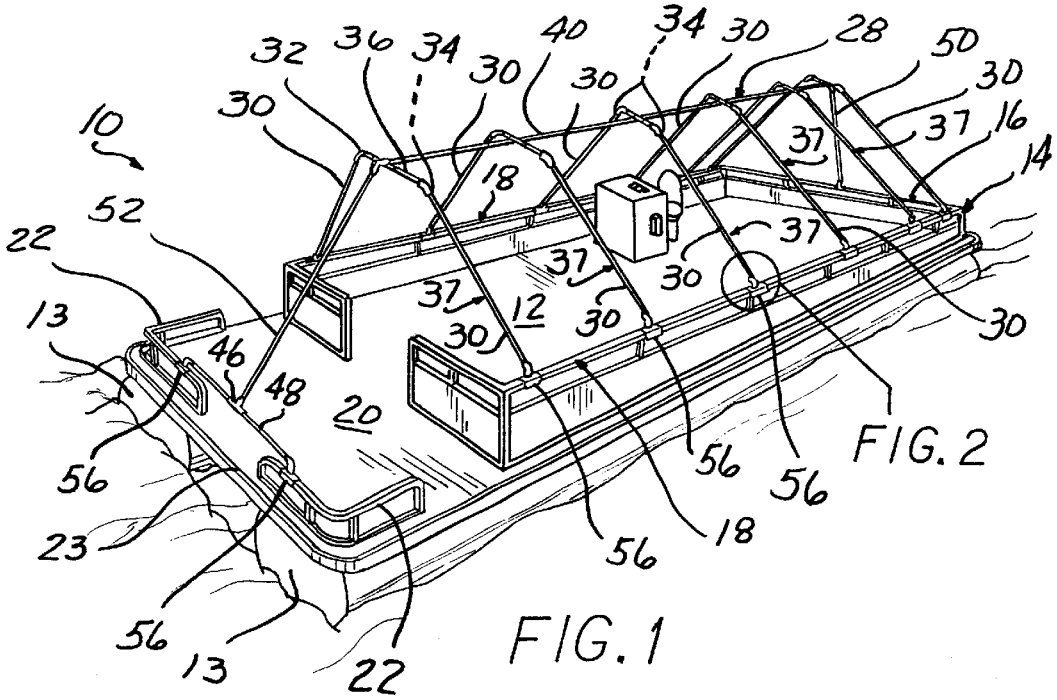
FIG. 1 is a perspective view of a pontoon boat incorporating the cover system of the present invention.
Figure 2:
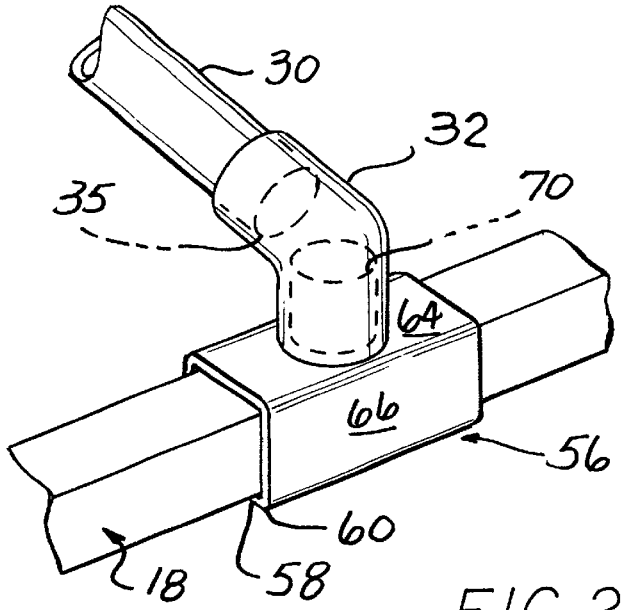
FIG. 2 is an enlarged view of the encircled area of FIG. 1 showing a bracket and fitting of the present invention installed on a rail of the pontoon boat.
Figure 3:
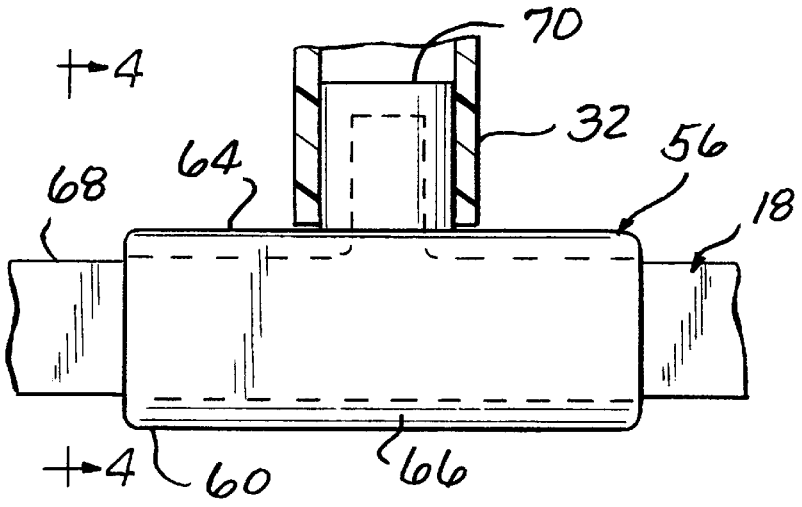
FIG. 3 is a side elevational view of the bracket of the present invention and a partial view of a fitting thereon.
Figure 4:
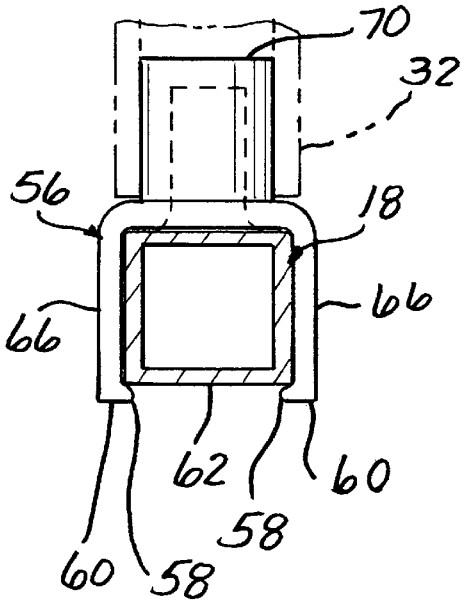
FIG. 4 is a view of the bracket taken along lines 4—4 of FIG. 3.
Figure 5:
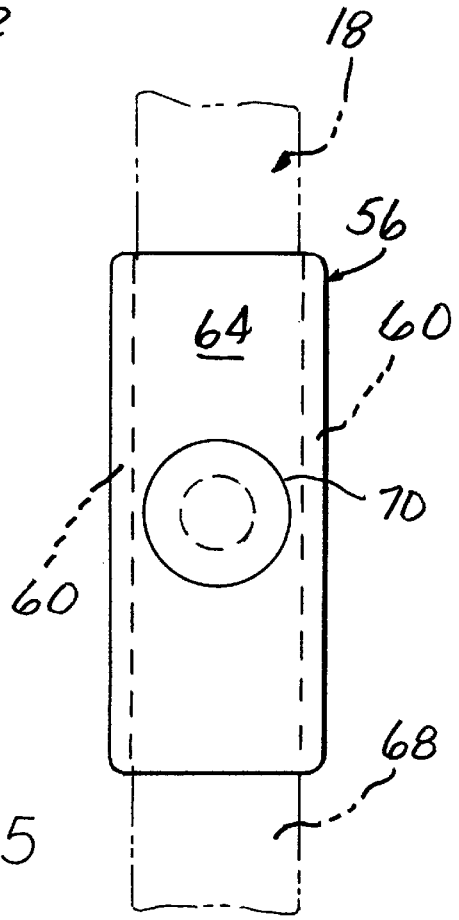
FIG. 5 is a top view of the bracket as installed on the rail.

Looking at FIG. 1, there is shown a typical pontoon boat 10. A pontoon boat includes a flat floor surface 12 secured to floatation devices 13. Some pontoon boats include a railing system 14 extending the entire perimeter of the floor surface 12. Other pontoon boats as shown in FIG. 1 include a railing system 14 along a portion of the perimeter of the pontoon boat 10, such that there is at least one end rail 16 and a pair of side rails 18 extending at least partially along lateral sides of the floor surface 12. The railing system 14 may entirely or partially traverse the flat floor surface 12 such that a decking area 20 is defined beyond the enclosure formed within the railing system 14. The decking area 20 may also be partially enclosed by a pair of discontinuous low deck rails 22 usually positioned at outer corners of the decking area 20. It is evident that other combinations of railing systems are available. The various railing systems available on pontoon boats 10 provide different considerations when designing a cover system for the pontoon than when designing a cover system for a typical boat.

A cover system is provided in the present invention that includes a frame system 28 adaptable for receiving a flexible or fabric material cover (not shown) thereon and attached to the frame system 28 by conventional methods. The frame system 28 includes elongated tubular members 30 for angular placement into an arched formation from the side rail 18. A pair of the elongate tubular members 30 are positioned parallel to each other along both sides of the side rails 18. The upper ends 34 of each pair of elongate tubular members 30 are inserted within one end each into individual elbow fittings 32. The upper ends may be releasably inserted within the elbow fitting 32 or may be securely attached to the fitting. A connector bar 36 traverses between the pair of elongate tubular members 30 and connects to the elongate tubular members at the elbow fittings 32. The lower ends 35 of each elongate tubular member 30 is held within other individual elbow fittings 32 which are connectable to the railing system 14 as will be discussed hereinafter. The pair of elongate tubular members 30 along with the connector bar 36 forms a frame section 37. A plurality of these frame sections 37 are positioned along and connected to the side rails 18. A center brace member 40 may extend and traverse across the plurality of connector bars 36 to provide stability to the frame system 28. The center brace member 40 may be connected to the plurality of connector bar members 36 by four-way fittings 42 at each connector bar member 36 or on elbow fittings 32 at each end frame section 37. A front and rear brace may be provided by extending a rear elongate tubular member 50 from the rearmost frame section 37 to the end rail 16 and a front elongate tubular member 52 from the frontmost frame section 37 to the opposing end rail or to a rail on the decking area 20. If a front angular elongate tubular member 52 extends over the decking area 20, as shown in FIG. 1, and if the deck rail 22 is discontinuous and does not span the entire second end 23 as shown in FIG. 1, the elongated member 52 may connect at a T-fitting 46 to a crossover bar 48 extending from one deck rail 22 to an adjacent deck rail 22. Connection of the crossover bar 48 is also made to the deck rail 22 at an elbow fitting 32.

In the aforementioned instances, the elongated members have ends that fit into an elbow fittings, T-fittings or other shaped fittings. The hollow fittings are tubular having ends which are configured for receiving an end of an elongated member 30 therein. Attachment means 56 to the railing system 14 are configured for releasable connection to the fittings 32 so that the attachment means 56 further connects the frame system 28 to the railing system 14 of the pontoon boat.

FIGS. 2–5 show the preferred embodiment of the attachment means 56 according to the present invention. The attachment means 56 includes a three sided, essentially U-shaped bracket 56 with inwardly directed protuberances 58 along lateral ends 60 of the attachment means 56 to grip or clip onto the underside 62 of the rail. The U-shaped bracket 56 is preferably made of a material, such as a nylon or plastic, that provides a slight flexibility to allow the lateral ends 60 to slightly expand when pressed over the rail so that the protuberances 58 grip around or snap against the underside 62 of the rail. The U-shaped bracket 56 includes a center section 64 between two lateral sections 66. The U-shaped bracket 56 is intended to be clipped onto the railing system 14 such that the center section 64 rests on the upper surface 68 of the rail 18. The center section 64 has an integral vertically extending portion 70 configured to be received in one end of the elbow fitting 32. The vertical extending portion 70 preferable has the same diameter as the elongate members 30 so that the vertical extending portion 70 fits snugly within the elbow fitting 32. The height of the vertical extending portion 70 is configured so that the end of the elbow fitting will lay flat against the center section 64 when installed over the vertically extending portion and also, provided an adequate height so that the fitting 32 will not easily slip off the vertical extending portion 70 when the elongate tubular member 30 is inadvertently moved.

Installing the cover system of the present invention is simply accomplished by connecting the elongate tubular member 30 and connector bars 36 into the appropriate elbow fitting to assemble the frame system as required by the particular pontoon model. The brackets 56 may be clipped on to the railing system 14 anytime before connecting the frame system 28 to the railing system 14. The brackets 56 may slide over the rail 18 to correctly position the brackets 56 for connecting to the individual frame sections 37. To complete connection, the lower end 35 of the elongate tubular member is inserted into one end of an elbow fitting 32 and the other end of the elbow fitting 32 is placed over the vertically extending portion 70 of the bracket 56.

The attachment means 56 in the shape of a bracket 56 as disclosed herein provides advantages over the prior art. The brackets 56 can be easily snapped off and on to a railing system 14 as required. The bracket 56 may also slide along the railing system 14 without having to remove clamps. Therefore, accurate positioning of the bracket 56 is easily attained. Clamps as well as nuts and bolts are not required to secure the bracket 56 onto a rail. Therefore, lost parts are minimized. Because clamps and nuts and bolts are not required the setup time or removal time of the frame system is minimized.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A cover system for a pontoon boat having a railing system extending above the floor of the boat and encompassing around at least a portion of the perimeter of the boat, said railing system defined by a pair of side rails and at least one end rail, said cover system comprising:

a frame system releasably attachable to the rail system at a plurality of locations, said frame system having elongate members interconnected into a plurality of arched formations, wherein said arched formations are connected by a traversely extending member, said elongate members having end portions mountable into one end of individual hollow fittings; and attachment means grippingly securable to the rail and having a vertically extending portion slidably mountable into the other end of the individual hollow fittings.

2. The cover system of claim 1, wherein the attachment means comprises a rail mount having a bracket configured to tightly fit on the rail, wherein said vertically extending portion is positioned in a center portion of the bracket.

3. The cover system of claim 2, wherein the bracket is configured as a three sided, open ended elongated box having a top portion and two side portions, said two side portions having edges with inwardly directed protuberances formed thereon.

4. The cover system of claim 3, wherein the frame system further has a first angular elongate member connected to one of the arched formations and extending to the end rail.

5. The cover system of claim 4, wherein the pontoon boat has deck rails and said deck rails are discontinuous across one end of the boat, wherein the frame system further comprises a crossover bar releasably connected to the discontinuous deck rails.

* * * * *